US008202131B2

(12) United States Patent
Battle

(10) Patent No.: US 8,202,131 B2
(45) Date of Patent: Jun. 19, 2012

(54) POWER LINE COUPLER

(75) Inventor: Robert James Battle, Yatala (AU)

(73) Assignee: Sicame Australia Pty Ltd, Yatala, Queensland (AU)

( * ) Notice: Subject to any disclaimer, the term of this patent is extended or adjusted under 35 U.S.C. 154(b) by 0 days.

(21) Appl. No.: 12/603,287

(22) Filed: Oct. 21, 2009

(65) Prior Publication Data

US 2011/0092112 A1 Apr. 21, 2011

(51) Int. Cl.
*H01R 11/09* (2006.01)

(52) U.S. Cl. ..... 439/796; 439/797; 439/810; 439/814

(58) Field of Classification Search ..... 439/796, 439/797, 810, 814, 879, 880; 174/84 R, 174/84 C
See application file for complete search history.

(56) References Cited

U.S. PATENT DOCUMENTS

| | | | | |
|---|---|---|---|---|
| 1,642,345 | A * | 9/1927 | Telford | 439/797 |
| 3,061,503 | A * | 10/1962 | Gould et al. | 174/84 C |
| 3,173,989 | A * | 3/1965 | Neaderland | 174/84 C |
| 3,281,524 | A * | 10/1966 | Lynch, Jr. et al. | 174/84 C |
| 3,681,512 | A * | 8/1972 | Werner et al. | 174/84 R |
| 3,864,013 | A * | 2/1975 | Levy | 439/724 |
| 3,976,385 | A * | 8/1976 | Klopfer | 403/284 |
| 4,079,189 | A | 3/1978 | Troccoli | |
| 4,099,021 | A | 7/1978 | Venezia | |
| 4,269,465 | A * | 5/1981 | Mueller | 439/431 |
| 4,314,093 | A | 2/1982 | Eldridge | |
| 4,829,146 | A * | 5/1989 | Duve | 174/94 R |
| 5,137,476 | A * | 8/1992 | Noble | 439/797 |
| 5,332,195 | A * | 7/1994 | Sugiyama | 254/371 |
| 5,422,438 | A * | 6/1995 | Lamome | 174/84 C |
| 5,821,463 | A * | 10/1998 | Ngo | 174/84 C |
| 6,875,045 | B1 * | 4/2005 | Hollick | 439/797 |
| 7,394,022 | B2 * | 7/2008 | Gumley | 174/84 C |

FOREIGN PATENT DOCUMENTS

| | | |
|---|---|---|
| JP | 10-322828 | 12/1998 |

* cited by examiner

*Primary Examiner* — Tho D Ta
(74) *Attorney, Agent, or Firm* — DeLio & Peterson, LLC; Kelly M. Nowak

(57) ABSTRACT

The present invention relates to a power line coupler for coupling a pair of cables together. The coupler comprises a protector for receiving and protecting the cables. A clamp is provided for clamping the protector and cables together. In many embodiments, the protector comprises an inner tube in which the cables can be inserted from opposite sides. In one embodiment, the clamp comprises an outer tube in which the protector is located.

21 Claims, 4 Drawing Sheets

POWER LINE COUPLER

TECHNICAL FIELD

The present invention generally relates to a power line coupler.

BACKGROUND

The reference to any prior art in this specification is not, and should not be taken as an acknowledgement or any form of suggestion that the prior art forms part of the common general knowledge.

An overhead power line is an electric power transmission line suspended by towers or poles. Overhead power lines are generally the lowest-cost method of transmission for large quantities of electric power in the range 1 kV to 800 kV. In practice, many overhead power line cables are bare conductors which make them hazardous.

During storms, trees or branches can fall over power lines causing them to break. It is desirable to quickly couple the two separate cables of a broken power line back together so as to remove the hazard, rather than go to the trouble and expense of re-installing a complete power line.

A known power line coupler for coupling a pair of cables together includes a helical conductor which is tightly wound from one cable onto the other. In practice, the repaired and sagging power line can swing in the wind (e.g. during subsequent storms) and the helical conductor can slip from a cable about which it is wound.

Another power line coupler includes a compressible conductor tube for receiving the cables. Once the cables are inserted, the tube can be compressed and deformed so as to clamp the cables therein. However, in practice, the cable thicknesses are prone to variation owing to different manufacturer's specifications. Accordingly, it may be difficult to insert some thicker cables into the tube whereas the tube may be inadequately clamped to other thinner cables which can make the joint susceptible to breakage once again.

SUMMARY

According to one embodiment of the present invention, there is provided a power line coupler for coupling a pair of cables together, the coupler comprising:

a protector for receiving and protecting the cables; and a clamp for clamping the protector and cables together.

The protector may comprise an inner tube in which the cables can be inserted from opposite sides. The inner tube may be made from deformable aluminum. The inner tube may widen at both ends. The inner tube may comprise an inner lubricant lining.

The clamp may comprise an outer tube in which the protector is located. The outer tube may comprise threaded holes in which respective fasteners can be engaged. The clamp may also comprise the fasteners each in the form of a bolt. The outer tube may be formed from aluminum.

The coupler may further comprise a pin extending through the protector and clamp.

According to another embodiment of the present invention, there is provided a power line coupler for coupling a pair of cables together, the coupler comprising:

an inner tube for receiving the cables; and an outer tube for receiving the inner tube.

The inner tube may widen at either end. The outer tube may comprise threaded holes in which respective fasteners can be engaged.

According to another embodiment of the present invention, there is provided a power line coupler for coupling a pair of cables together, the coupler comprising:

protector means for receiving and protecting the cables; and clamp means for clamping the protector means and cables together.

According to another embodiment of the present invention, there is provided a power line coupler for coupling a pair of cables together, the coupler comprising:

a protector device for receiving and protecting the cables; and a clamp device for clamping the protector device and cables together.

According to another embodiment of the present invention, there is provided a power line coupling method for coupling a pair of cables together, the method comprising:

receiving the cables within a protector; and clamping the protector and cables together.

BRIEF DESCRIPTION OF THE DRAWINGS

Features, embodiments and variations of the invention may be discerned from the following Detailed Description which provides sufficient information for those skilled in the art to perform the invention. The Detailed Description is not to be regarded as limiting the scope of the preceding Summary in any way. The Detailed Description will make reference to a number of drawings as follows.

DETAILED DESCRIPTION OF THE DRAWINGS

Figure 1:
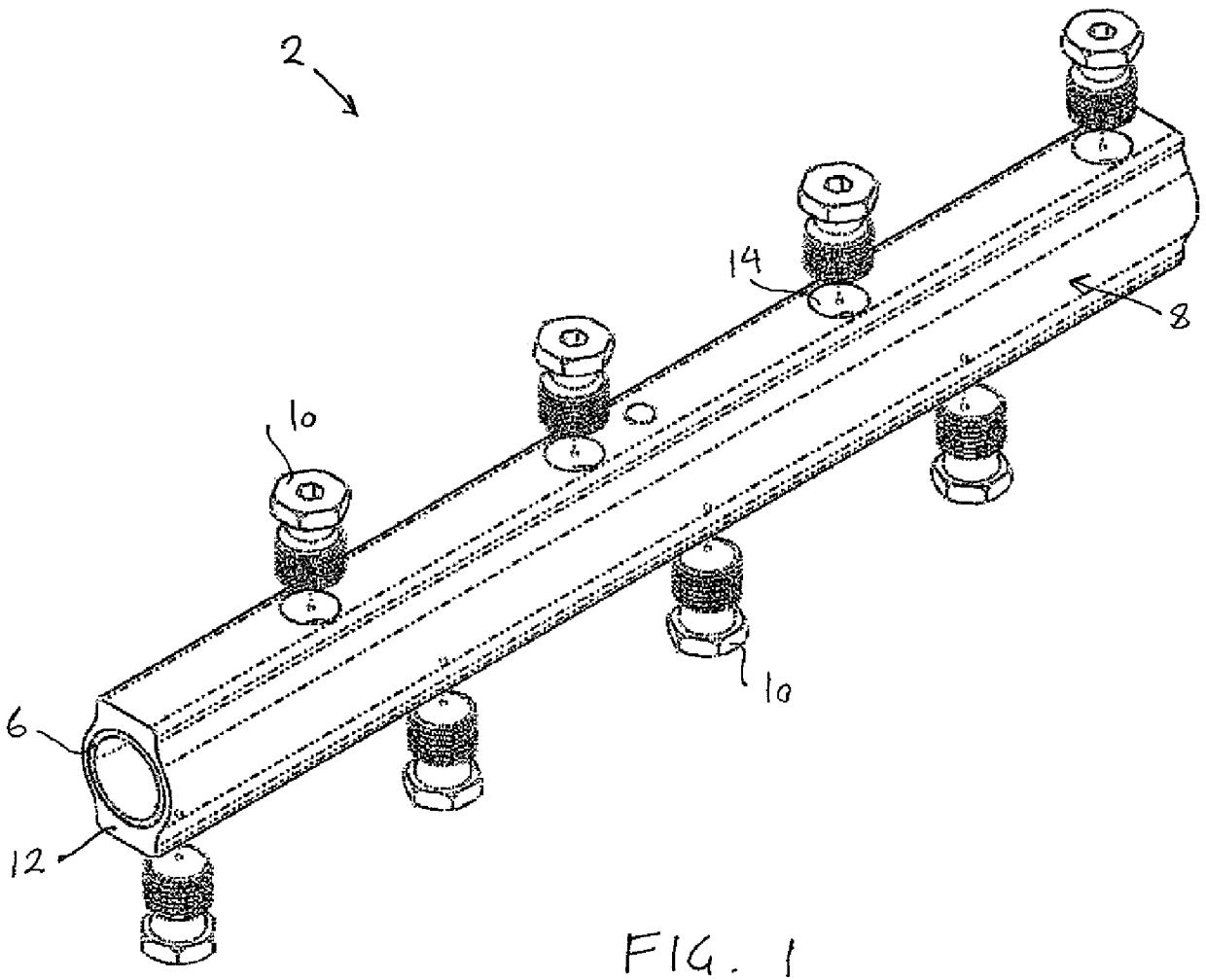
FIG. 1 is a perspective view of a power line coupler in accordance with an embodiment of the present invention.
Figure 2:
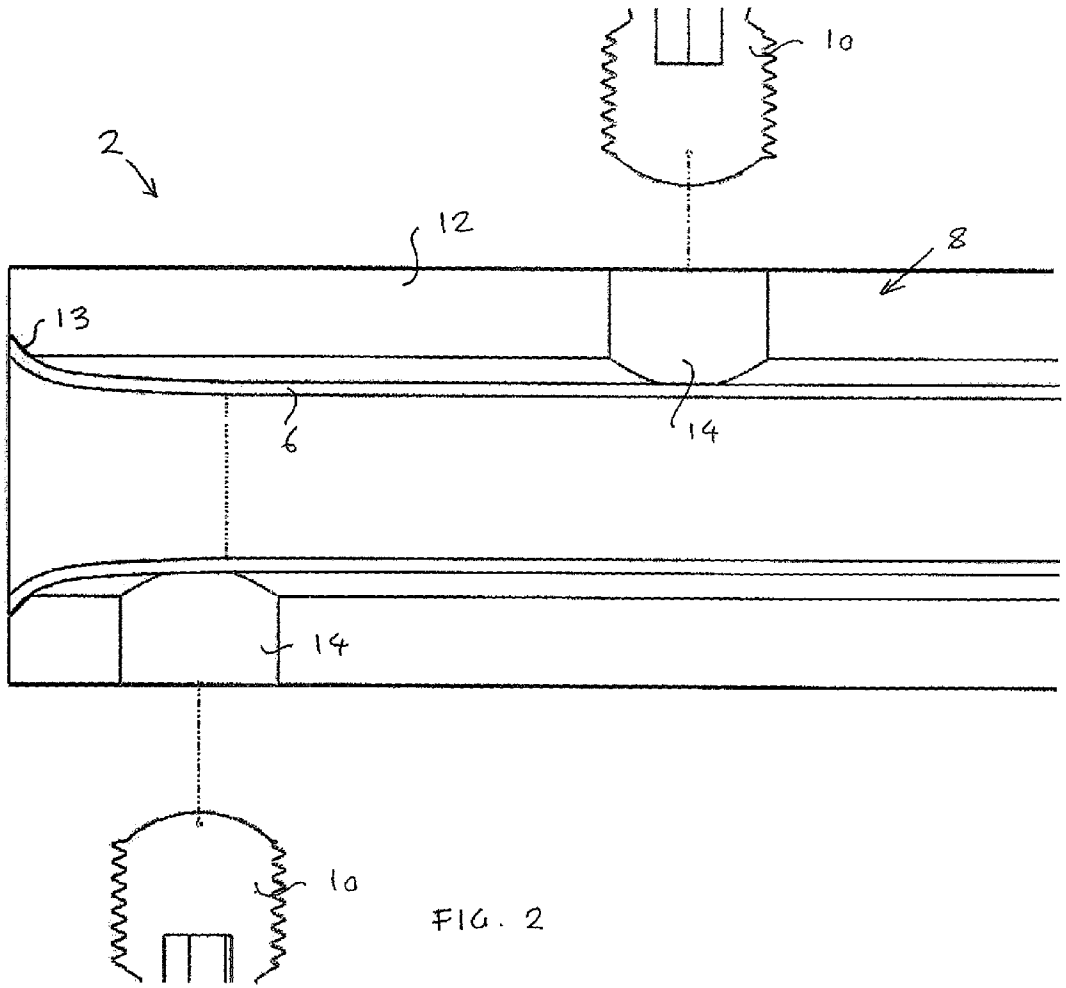
FIG. 2 is a partial side sectional view of the power line coupler of FIG. 1.
Figure 3:
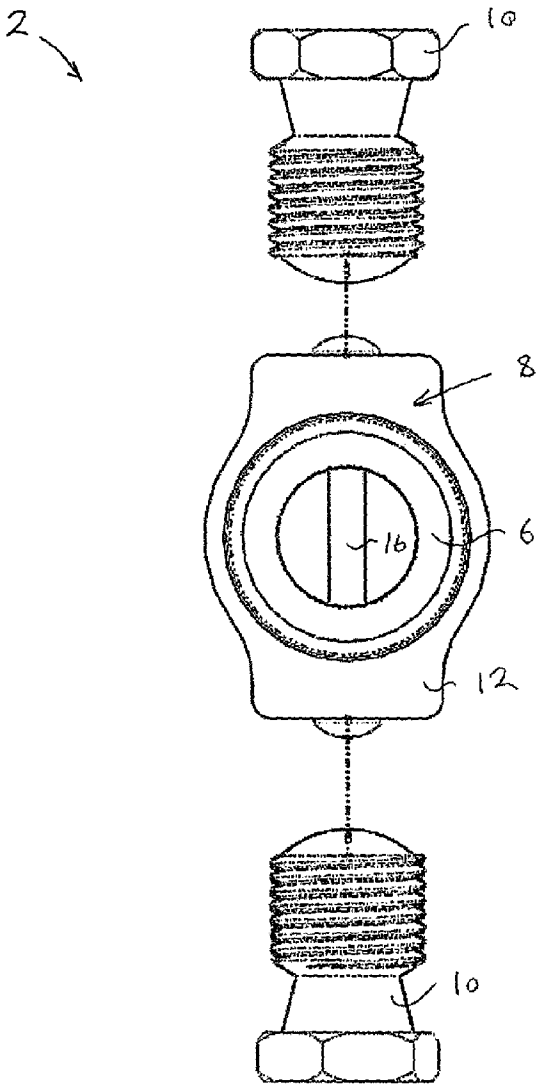
FIG. 3 is an end view of the power line coupler of FIG. 1.

According to an embodiment of the present invention, there is provided a power line coupler 2 as shown in FIGS. 1 to 3. The power line coupler 2 is suitable for electrically coupling a pair of cables 4*a*, 4*b* together as shown in FIG. 4.

Turning firstly to FIG. 1, the coupler 2 comprises a tubular protector 6 for receiving and protecting the cables 4 from damage by the base of clamp fasteners 10. A tubular clamp 8 can be used to clamp the protector 6 and cables 4 together so that the cables 4 are coupled together and resist slipping from the protector 6.

Figure 4:
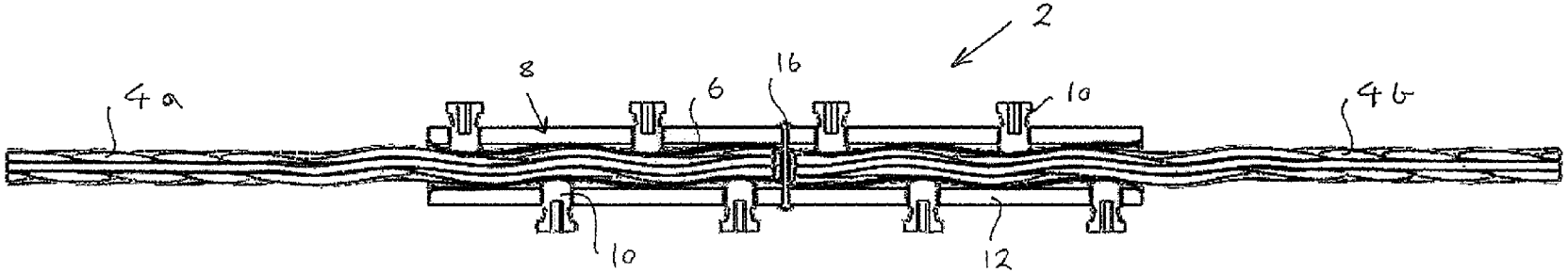
FIG. 4 is a side sectional view of the power of the power line coupler of FIG. 1 coupling a pair of cables together.

The protector 6 is in the form of an inner tube in which the cables 4*a*, 4*b* can be inserted from opposite sides (FIG. 4). To facilitate insertion of the cables 4, the protector 6 comprises an inner lubricant in the form of grease. As can best be seen in FIG. 2, the protector 6 widens at both ends so as to be retained within the clamp 8. The protector 6 is formed from deformable aluminum and becomes corrugated (or undulates) when clamped so as to further resist extraction from the clamp 8.

The clamp 8 comprises an outer tube 12 in which the protector 6 is located. The outer tube 12 comprises threaded holes 14 in which respective fasteners 10 can be engaged. The clamp 8 comprises the fasteners which each take the form of a bolt. The outer tube 12 is formed from comparatively durable aluminum and has chamfered or beveled inner edges 13 which engage with the widened ends of the protector 6.

As can best be seen in FIG. 3, the coupler 2 further comprises a pin 16 extending through the protector 6 and clamp 8. The pin 16 holds the protector 6 within the clamp 8 and further provides a stop against which the cables 4 can be positioned when fully inserted in the coupler 2.

The method for coupling a pair of cables 4*a*, 4*b* of a broken power line together with the coupler 2 is described in detail below.

Initially, the cables 4*a*, 4*b* are inserted within opposite ends of the protector 6.

The clamp 8 is clamped onto the protector 6 so that the protector 6 and cables 4*a*, 4*b* are clamped together. Elaborating further, the fasteners 10 are tightened which, in turn, deforms the protector 6. As previously explained, the protector 6 protects the strands of each cable 4 from damage during tightening of the fasteners 10.

In many embodiments, the cables 4 can be firmly held within the protector 6, irrespective of their diameter. Each of the aluminum protector 6, clamp 8 and fasteners 10 are electrically conductive so that the cables 4*a*, 4*b* are electrically coupled together.

Typically, the cables 4*a*, 4*b* are bare (i.e. not insulated). In one embodiment, insulation can instead be stripped from the ends of the cables 4*a*, 4*b* prior to coupling them together.

A person skilled in the art will appreciate that many embodiments and variations can be made without departing from the ambit of the present invention.

The coupler 2 of some embodiments comprises a single protector 6 and a single clamp 8. In alternative embodiments, the coupler may instead comprise a protector means comprising two or more protectors. In yet other embodiments, the coupler may instead comprise a clamp means comprising two or more clamps. In some embodiments, the coupler 2 may instead comprise a protector device comprising one or more protectors. In further embodiments, the coupler 2 may comprise a clamp device comprising one or more clamps.

The skilled person will appreciate that the dimensions of the protector 6 and clamp 8 can be varied to suit the dimensions of the cables 4. Furthermore, the number of fasteners 10 for the clamp 8 can be varied and increase with increasing cable diameter.

In compliance with the statute, embodiments of the invention have been described in language more or less specific to structural or methodical features. It is to be understood that the invention is not limited to specific features shown or described since the means herein described comprises examples of putting the invention into effect. Embodiments are, therefore, claimed in any of various forms or modifications within the proper scope of the appended claims appropriately interpreted by those skilled in the art.

What is claimed is:

1. An overhead power line coupler for coupling a pair of cables together, the coupler comprising:

a protector for receiving and protecting the cables; and a clamp that clamps the protector and cables together, the clamp including inwardly extending protrusions residing alternatingly on opposing sides of the protector having the cables therein such that the inwardly extending protrusions engage with and bend the protector such that both the protector and cables reside in bent curved or angular forms that impede removal of the cables from the protector.

2. A power line coupler as claimed in claim 1, further comprising a pin extending through the protector and clamp.

3. A power line coupler as claimed in claim 1, wherein the protector comprises an inner tube clamped against the cables inserted from opposite sides, the protector being corrugated and resisting extraction from the clamp.

4. A power line coupler as claimed in claim 3, wherein the inner tube is formed from permanently deformable aluminum and comprises an inner lubricant.

5. A power line coupler as claimed in claim 3, wherein the inner tube widens at both ends.

6. A power line coupler as claimed in claim 1, wherein the clamp comprises an outer tube in which the protector is located.

7. A power line coupler as claimed in claim 6, wherein the outer tube is formed from aluminum and has chamfered or beveled inner edges.

8. A power line coupler as claimed in claim 6, wherein the outer tube comprises oppositely and alternately disposed threaded holes in which respective fasteners can be engaged, shafts of the fasteners being the protrusions.

9. A power line coupler as claimed in claim 8, wherein the fasteners are each in the form of a bolt.

10. A power line coupler as claimed in claim 1, wherein the protector comprises one or more tubes.

11. A power line coupler as claim in claim 10, wherein the clamp comprises one or more tubes.

12. A power line coupler for coupling a pair of cables together, the coupler comprising:

an inner tube for receiving the cables;

an outer tube for receiving the inner tube;

a pin extending completely through the tubes; and fasteners that extend inwardly through the outer tube, and engage with and bend the inner tube thereby fastening the cables within the inner tube such that both the cables and the bent inner tube reside in curved or angular forms that impede removal of the cables from the inner tube.

13. A power line coupler as claimed in claim 12, wherein the inner tube widens at both ends and the outer tube has chamfered or beveled inner edges for engaging with the inner tube.

14. A power line coupler as claimed in claim 12, wherein the outer tube comprises oppositely and alternately disposed threaded holes in which respective fasteners can be engaged.

15. A power line coupler as claimed in claim 12, wherein the fasteners can extend through the outer tube to corrugate the inner tube and the inner tube resists extraction from the outer tube.

16. An overhead power line coupler for coupling a pair of cables together, the coupler comprising:

protector means of a permanently deformable material for receiving and protecting a pair of cables; and clamp means that clamps the protector means and cables together, the clamp means including inwardly extending protrusions residing alternatingly on opposing sides of the protector means having the cables therein such that the inwardly extending protrusions engage with and bend the protector means so that both the protector means and cables residing therein reside in curved or angular forms that impede removal of the cables from the protector means.

17. A power line coupler as claimed in claim 16, wherein the protector means comprises a single tube which can be deformed by the clamp means to become corrugated thereby resisting extraction from the clamp means.

18. A power line coupler as claimed in claim 16, wherein the clamp means comprises a single clamp and the protrusions are oppositely and alternately disposed.

19. An overhead power line coupling method for coupling a pair of cables together, the method comprising:

receiving the cables within a protector;

providing a clamp having inwardly extending fasteners residing alternatingly on opposing sides of the protector having the cables therein; and clamping the protector and cables together with the inwardly extending fasteners that engage with and bend the protector by applying pressure to the protector and cables therein, thereby bending both the protector and cables from a straight form into a curved or angular form that impedes removal of the cables from the protector.

20. The method of claim 19 wherein the protector comprises one or more tubes.

21. The method of claim 19 wherein the clamp comprises one or more tubes.

* * * * *